US010472836B2

(12) United States Patent
Grussenmeyer et al.

(10) Patent No.: US 10,472,836 B2
(45) Date of Patent: Nov. 12, 2019

(54) REINFORCEMENT DEVICES, SYSTEMS AND METHODS FOR CONSTRUCTING AND REINFORCING THE FOUNDATION OF A STRUCTURE

(71) Applicant: SWS Innovations, LLC, Chatham, IL (US)

(72) Inventors: Philip J. Grussenmeyer, Chatham, IL (US); Steven Robert Beach, Varna, IL (US)

(73) Assignee: SWS Innovations, LLC, Chatham, IL (US)

( * ) Notice: Subject to any disclaimer, the term of this patent is extended or adjusted under 35 U.S.C. 154(b) by 0 days.

(21) Appl. No.: 16/186,871

(22) Filed: Nov. 12, 2018

(65) Prior Publication Data

US 2019/0127977 A1 May 2, 2019

Related U.S. Application Data

(63) Continuation of application No. 15/720,157, filed on Sep. 29, 2017, now abandoned.

(60) Provisional application No. 62/401,381, filed on Sep. 29, 2016.

(51) Int. Cl.
*E04G 23/02* (2006.01)
*E04H 12/22* (2006.01)

(52) U.S. Cl.
CPC ..... *E04G 23/0218* (2013.01); *E04H 12/2292* (2013.01)

(58) Field of Classification Search
CPC . E04G 23/02; E04G 23/0225; E04G 23/0218; E04H 12/2292
See application file for complete search history.

(56) References Cited

U.S. PATENT DOCUMENTS 574,641 A * 1/1897 Streator ..... E04H 12/2292 52/302.5
937,448 A * 10/1909 Lamb ..... E04H 12/2292 52/835
1,609,874 A * 12/1926 Heydon ..... E04H 12/2292 138/157
2,707,034 A * 4/1955 Hetrick ..... E04H 12/00 52/835

(Continued)

OTHER PUBLICATIONS

Brochure—Osmose Truss Systems (www.osmose.com).

(Continued)

*Primary Examiner* — Andrew J Triggs
(74) *Attorney, Agent, or Firm* — Stephen T. Scherrer; Monique A. Morneault; Scherrer Patent & Trademark Law, P.C.

(57) ABSTRACT

The present disclosure relates to reinforcement devices, systems and methods for use in constructing new structures, including post frame structures. Specifically, the present disclosure relates to reinforcement devices, systems and methods for replacing traditional wood and/or precast concrete columns utilized in building a new construction foundation, with a height adjustable foundation column assembly constructed from a corrosion resistant material. The present disclosure also relates to reinforcement devices, systems and methods useful for reinforcing existing post frame structures, particularly those with framing elements requiring repair.

6 Claims, 12 Drawing Sheets

(56) References Cited

U.S. PATENT DOCUMENTS 3,027,140 A 3/1962 Holzbach
4,066,372 A * 1/1978 Swanson ..... E04H 12/2292 174/45 R
4,516,365 A * 5/1985 Chapman ..... E04H 12/2292 52/170
5,311,713 A * 5/1994 Goodrich ..... E04H 12/2292 52/301
5,369,925 A * 12/1994 Vargo ..... B65G 1/02 211/183
5,622,356 A * 4/1997 Duggan ..... E04H 12/2292 256/1
5,819,482 A 10/1998 Belke
6,079,165 A * 6/2000 Bingel, III ..... E04G 23/0218 52/170
6,349,512 B1 2/2002 Berkey
6,364,575 B1 * 4/2002 Bradley ..... E02B 17/0026 405/216
6,773,206 B2 * 8/2004 Bradley ..... E02B 17/0026 405/215
6,964,139 B2 11/2005 Meyer et al.
D521,656 S * 5/2006 Terrels ..... D25/122
7,343,713 B2 3/2008 Knepp et al.
7,363,752 B2 * 4/2008 Bingel, III ..... E04C 3/30 52/835
7,415,808 B2 * 8/2008 Bingel, III ..... E04C 3/30 52/834
7,454,872 B2 11/2008 Cutforth
7,574,841 B2 8/2009 Knepp et al.
7,677,522 B2 3/2010 Bakos
7,815,157 B2 * 10/2010 Knight ..... E04G 23/0218 248/219.4
8,122,652 B2 * 2/2012 Knight ..... E04H 12/2292 52/170
8,235,346 B2 8/2012 Bakos
8,381,462 B1 2/2013 Sims
8,407,967 B2 4/2013 Brindle
8,453,416 B2 6/2013 Brindle
8,826,629 B1 9/2014 Brindle
9,085,915 B1 * 7/2015 Emmett ..... E04H 12/2292
9,217,248 B2 12/2015 Knepp
9,359,785 B2 * 6/2016 Catt ..... A01G 17/14
9,366,052 B1 6/2016 Warner et al.
9,540,814 B2 1/2017 Meyer et al.
9,611,666 B1 * 4/2017 Neighbor ..... E04H 12/08
9,677,297 B2 6/2017 Warner et al.
9,732,521 B2 8/2017 Babikian
9,771,734 B2 * 9/2017 Odegard ..... E04H 12/2292
9,777,500 B1 * 10/2017 Reisdorff ..... E04H 12/2292
2002/0094239 A1 * 7/2002 Bradley ..... E02B 17/0026 405/216
2003/0006354 A1 1/2003 Biles
2005/0056760 A1 3/2005 Carlson
2005/0210821 A1 * 9/2005 Bingel, III ..... E04C 3/30 52/834
2005/0211454 A1 * 9/2005 Bingel, III ..... E04C 3/30 174/45 R
2009/0293422 A1 12/2009 Brindle, Jr.
2010/0098499 A1 4/2010 Bakos
2010/0129147 A1 5/2010 Wrightman
2010/0300038 A1 12/2010 Brindle
2014/0260082 A1 9/2014 Brindle
2014/0373471 A1 12/2014 Knepp
2015/0013267 A1 * 1/2015 Huncovsky ..... E04G 23/02 52/835
2015/0082742 A1 * 3/2015 Catt ..... A01G 17/14 52/835
2016/0060892 A1 * 3/2016 Odegard ..... E04H 12/2292 52/835
2016/0130833 A1 * 5/2016 Catt ..... E04H 12/2292 248/530
2016/0177592 A1 * 6/2016 Butler ..... E04H 12/2292 52/301
2017/0073972 A1 3/2017 Gilbert
2018/0087273 A1 3/2018 Grussenmeyer et al.

OTHER PUBLICATIONS https://www.strongtie.com/nonstandoffcolumnbases_columnbases/cbqgt_base/p/cbqgt.
https://www.strongtie.com/standoffcolumnbases_columnbases/cbs-cbsq_productgroup_wcc/p/cbs.cbsq.
https://www.permacolumn.com/products/sturdi-wall.
https://www.concretepiersystem.com.
http://www.postframeadvantage.com/design/foundations/poured-in-place-concrete-pier.

* cited by examiner

REINFORCEMENT DEVICES, SYSTEMS AND METHODS FOR CONSTRUCTING AND REINFORCING THE FOUNDATION OF A STRUCTURE

This application is a continuation application of U.S. Ser. No. 15/720,157 filed on Sep. 29, 2017, which claims priority to U.S. Provisional Application Ser. No. 62/401,381 filed Sep. 29, 2016, which is incorporated in its entirety.

TECHNICAL FIELD

The present invention relates to reinforcement devices, systems and methods useful for constructing and reinforcing a structure. Specifically, one embodiment of the reinforcement device is an adjustable foundation system for use as reinforcement structural columns, posts and/or supports for a structure, particularly for use in the construction of pole barns and other buildings. The present invention also relates to a system and method for raising the height of an existing building or structure using a reinforcement device, thereby providing more useful interior space for accommodating large pieces of equipment and/or for providing more storage capacity.

BACKGROUND

It is, of course, generally known to construct a structure, such as a shed, barn, garage, etc., using wooden posts set into a series of holes dug in the ground to define a perimeter and create the initial frame for the structure. In the case of pole barns, the structural or framing posts are buried in the ground, and often surrounded by dirt, gravel or concrete. However, long-term contact of wooden posts with the ground can lead to post rot of these wood pilings, resulting in potential structural failure, often prematurely. Additionally, many older structures, such as older barns, with wood columns embedded into the ground subject to decay, rotting, and insect infestation, which can affect the overall integrity of the structure. However, it is often desirable to repair older, wood frame structures to maintain their integrity for various reasons including costs, convenience and history.

Improvements continue to be made to provide longevity, durability and strength to post frame buildings. The traditional method of repair requires that large holes be excavated within the building next to and/or around each post. A new post is then installed next to the existing post and the posts are bolted together. With this traditional method, there is typically no new foundation installed and no additional uplift protection. Opening up large holes including breaking and tearing out concrete flooring around the existing columns is invasive, labor intensive and costly. Additionally, most traditional repairs will take several days to a week to complete, and can be expensive.

For decades, post frame buildings were built all across America that were designed to store equipment and machinery that was much smaller in stature than what is in use on today's modern farms. As a result, many of these otherwise useful buildings are being removed to make room for new buildings with higher interior clearances to accommodate today's larger farm machinery. However, razing a structure and building a new one can be time-consuming and expensive. Additionally, many older structures have value, not only historically but may also have sentimental value to the owner. Therefore, a need exists for refurbishing existing buildings by extending existing wood columns to increase the interior space clearance, thereby providing the interior height and space needed for today's modern farm equipment.

Additionally, there exists a need for options to the traditional wood post construction of foundations for new buildings. Replacing traditional wood foundations with easy to use columns made of material able to withstand rot, decay and insect damage that traditional wooden posts are susceptible to, or expand and contract due to freezing and thawing, results in a structure more durable and well-protected against destructive natural forces than the average post frame building foundation. Because each column can be stabilized and adjusted both vertically and horizontally the integrated grade board bracket allows the wall post to interlock. This allows the entire foundation system to be stabilized and minor, if any, post movement occurs when backfilling the excavated holes with concrete, resulting in a solid, precise foundation system. Moreover, the lack of pre-cast concrete posts eliminates the possibility of blow outs that can compromise the integrity of the foundation's concrete.

A need, therefore, exists for improved devices, systems and methods for reinforcing a structure. Specifically, a need exists for improved devices, systems and methods for reinforcing and stabilizing failing structural elements including structural and framing posts quickly and easily.

A need further exists for improved devices, systems and methods for providing a reinforcement device for use in constructing an improved foundation for a structure wherein the foundation is resistant to the elements, rot and decay and insect infestation.

Additionally, a need exists for improved devices, systems and methods for constructing a foundation using preassembled columns, and the pre-drilled holes which make for simple attachment to boards and planks used in the construction of a foundation for a structure. This saves time and increases labor efficiency.

A need further exists for improved devices, systems and methods for constructing a foundation utilizing columns much lighter than traditional wooden posts or precast concrete columns, making lifting safer and easier for the worker and reducing the need for heavy machinery to assist in transportation and installation.

Further, a need exists for improved devices, systems and methods for providing a reinforcement device useful in raising the height of an existing structure.

Moreover, a need exists for improved devices, systems and methods for reinforcing wooden posts or columns of an existing structure using fewer tools and workers to install the device.

A need further exists for improved devices, systems and methods for providing an efficient and time-saving structurally sound repair to failing columns supporting a building.

Additionally, a need exists for improved devices, systems and methods for constructing a new structure while further protecting it from future decay and potential insect infestation.

A need further exists for improved devices, systems and methods reinforcing and stabilizing a structure utilizing a multi-sided sleeve device for surrounding and reinforcing an existing structural wooden post.

A need further exists for improved devices, systems and methods for stabilizing a structure and providing additional uplift and lateral strength to increase the height of an existing structure thereby increasing the useful interior space of the structure. Often times minor height loss is due to sagging from the breakdown of wood columns and settlement.

Additionally, a need exists for repairing and or straightening sagging walls, and providing improved structural integrity to an existing structure so it can better withstand damage from storms, including potential wind damage.

Moreover a need exists for an improved devices and systems adaptable for reinforcing a structural element, such as a post for a pole building, have a variety of shapes and sizes.

Further, a need exists for improved devices, systems and methods for a structurally sound repair of existing structural columns at a fraction of the cost to replace existing structural elements or even an entire structure.

SUMMARY

The present disclosure relates to reinforcement devices, systems and methods for use in constructing new structures, and repairing post frame structures. Specifically, the present disclosure relates to foundation systems, reinforcement devices, systems and methods for replacing traditional wood and/or precast concrete posts utilized in constructing or repairing existing post frame foundation components. The present disclosure provides a new construction foundation, with a height adjustable foundation column assembly constructed from corrosion resistant materials.

In one exemplary embodiment, the present disclosure relates to a reinforcement device for constructing and supporting a foundation for a structure, the device comprising a column body having a top and a bottom, a bracket secured to the top of the column body, a height adjustment mechanism positioned above and passing through the bracket and within an interior space of the column body extending from top to bottom, the adjustment mechanism capable of vertically moving the column body and bracket between any desired height, and, a stabilizer pad secured to an end of the height adjustment mechanism opposing the top of the column body.

In another embodiment, the present disclosure relates to a method for creating a foundation for a structure. The method includes the steps of outlining a perimeter of a structure through the excavation of a plurality of holes having a ground floor, providing a height adjustable column assembly comprising, a column body having a top and a bottom, a bracket secured to the top of the column body, a height adjustment mechanism extending above and downward through the bracket within an interior space of the column body to the bottom, the height adjustment mechanism capable of vertically moving the column body and bracket between any desired height; and, a stabilizer pad secured to an end of the height adjustment mechanism opposite the top of the column body, positioning each height adjustable column assembly within each hole forming the perimeter, wherein the bracket is above ground level and the stabilizer pad is positioned on the ground floor of the hole, adjusting each height adjustable column assembly through the height adjustment mechanism to an acceptable level position; and, disposing at least one board on each of the brackets, forming an initial foundation for the structure.

In another exemplary embodiment, the present disclosure relates to a reinforcement device useful for securing to and stabilizing existing structural posts of a building such as wooden support columns of a post frame or pole buildings. The reinforcement device has a multi-sided corrugated structure, which is adaptable for engagement with structural posts having a variety of shapes and sizes. Additionally, the present disclosure relates to a system and method for increasing the height of an existing structure, due to sagging from a breakdown of wood columns and settlement, or increasing the height of the entire structure, thereby increasing the useable interior clearance space to accommodate large pieces of equipment.

To this end, in an embodiment of the present invention, a device for reinforcing an existing structural element of a building is provided. The device comprises a multi-sided sleeve having an elongated body comprising a longitudinal center section integrally connected along opposing edges to a pair of opposing longitudinal legs or panels having a length the same as the center section. Each leg is connected at an angle or bend to the center section, wherein the angle can vary depending on the size of the structural element.

In an embodiment, a reinforcement device is provided for use in reinforcing an existing structural column. The reinforcement device comprises a multi-sided structure, having a center longitudinal section flanked on either side and integrally connected to a pair of opposing legs, wherein the legs have the same longitudinal length as the center section. Each of the center section and legs further include a raised portion or apex substantially in the middle of the center section and each leg, wherein the raised portions provide an overall corrugated structure to the device and intermittent contact with the column.

In another embodiment of the present invention, a system and method for increasing the height and interior space of an existing structure is provided. The system and method includes the steps of providing an suitable reinforcement device, creating a space around an existing column or post, placing the reinforcement device around the existing column, driving the reinforcement device below grade to the original foundation pad, cutting the existing column and supporting it with the reinforcement device, and lifting the structure to the desired height. Once this is achieved a wood spacer block can be installed between the severed column to direct the load back to the original foundation. Fasteners are installed to adjoin the pieces together.

It is, therefore, an advantage and objective of the present disclosure to provide a reinforcement device, system and method useful for creating a foundation for a structure that is resistant to temperature changes, decay, and insect infestation.

It is, therefore, an advantage and objective of the present disclosure to provide a reinforcement device, system and method for reinforcing and stabilizing existing structural elements of a building including structural and framing posts, quickly and easily.

It is further an advantage and objective of the present disclosure provide an improved reinforcement device, system and method for stabilizing a structure and providing reinforcement to existing foundation columns and uplift strength to increase the height of an existing structure thereby increasing the useful interior space of the structure or to lift to correct any sagging resulting from failing wood columns.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present disclosure relates to devices, systems and methods for constructing a foundation and replacing the traditional wood and/or precast concrete columns used for supporting a structure, such as a post-frame building. Specifically, the present disclosure relates to improved reinforcement devices, systems and methods useful in the construction of solid, corrosion-resistant foundations for new buildings, including pole or post-frame buildings. The present disclosure also relates to another embodiment of improved reinforcement devices, systems and methods useful for reinforcing and stabilizing existing structural posts of a building, such as existing wooden columns of a post frame or pole buildings. Additionally, the present disclosure relates to a system and method for utilizing a reinforcement device for increasing the height of an existing structure, thereby increasing the useful interior space of a structure to accommodate larger pieces of equipment and machinery and/or to provide additional storage capacity.

Figure 3:
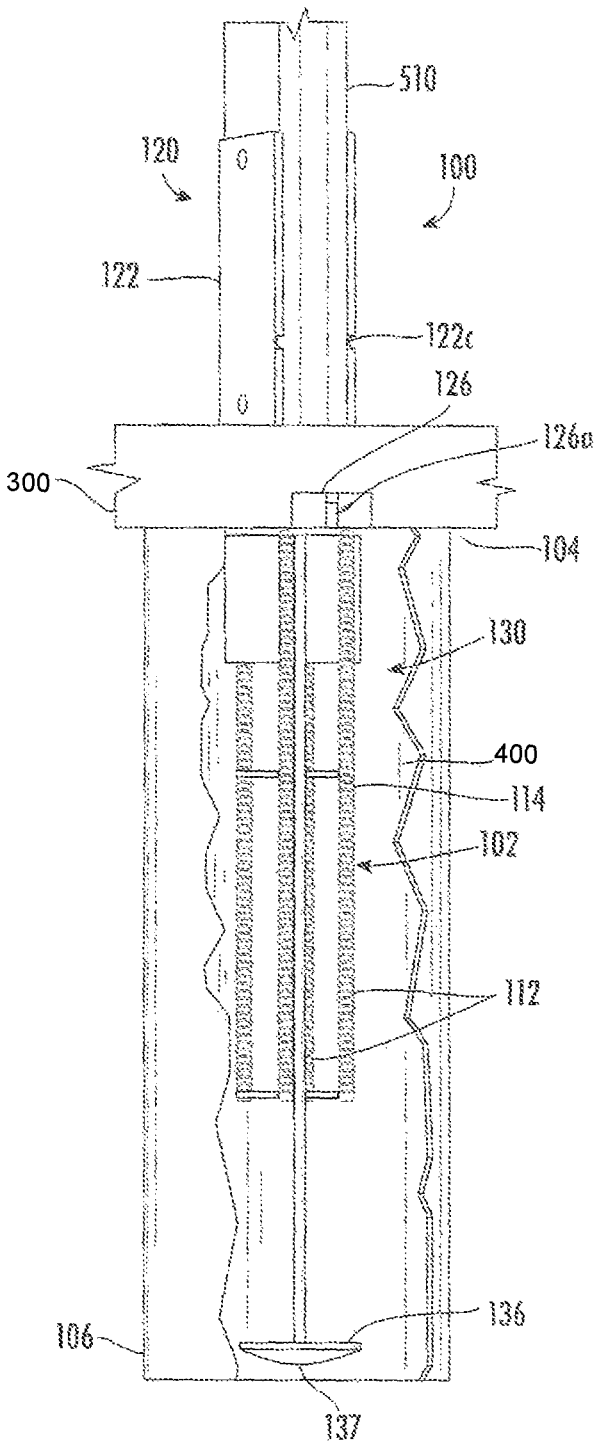
FIG. 3 illustrates an embodiment of the height adjustable column assembly according to the present disclosure.
Figure 4:
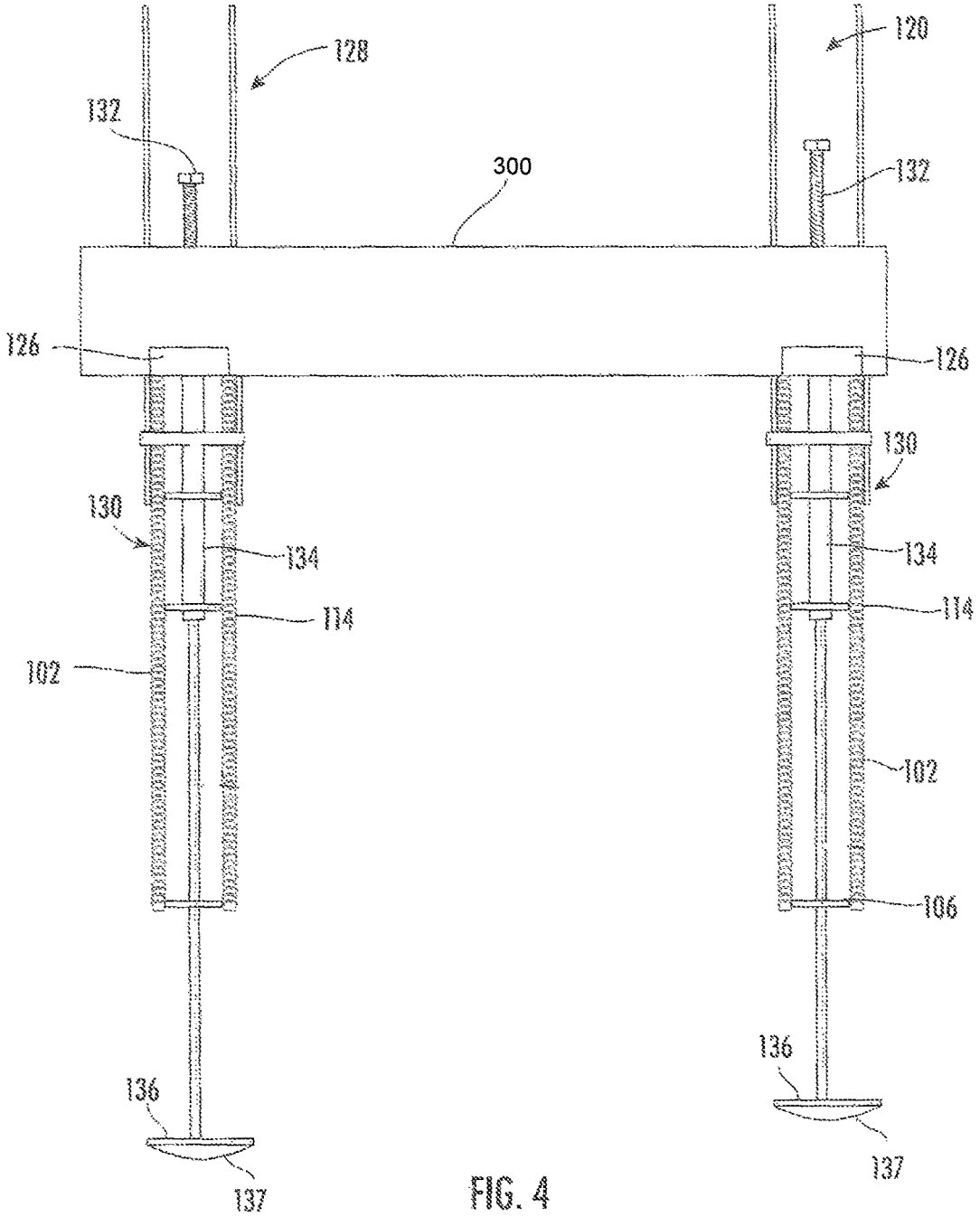
FIG. 4 illustrates an embodiment of a the height adjustable column assembly according to the present disclosure supporting a board for a structure.
Figure 5:
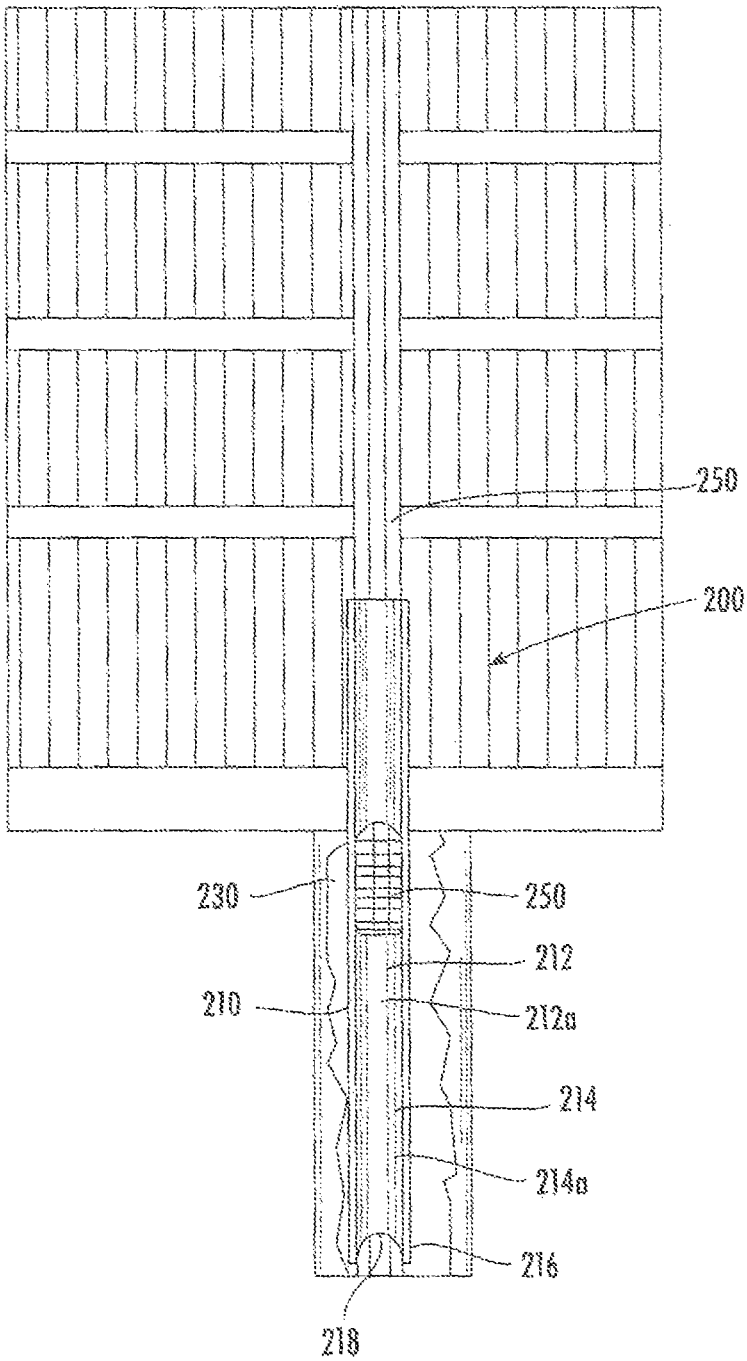
FIG. 5 illustrates an interior view of a post frame structure incorporating an embodiment of a reinforcement device, particularly a reinforcement sleeve according to the present disclosure.
Figures 6, 6A:
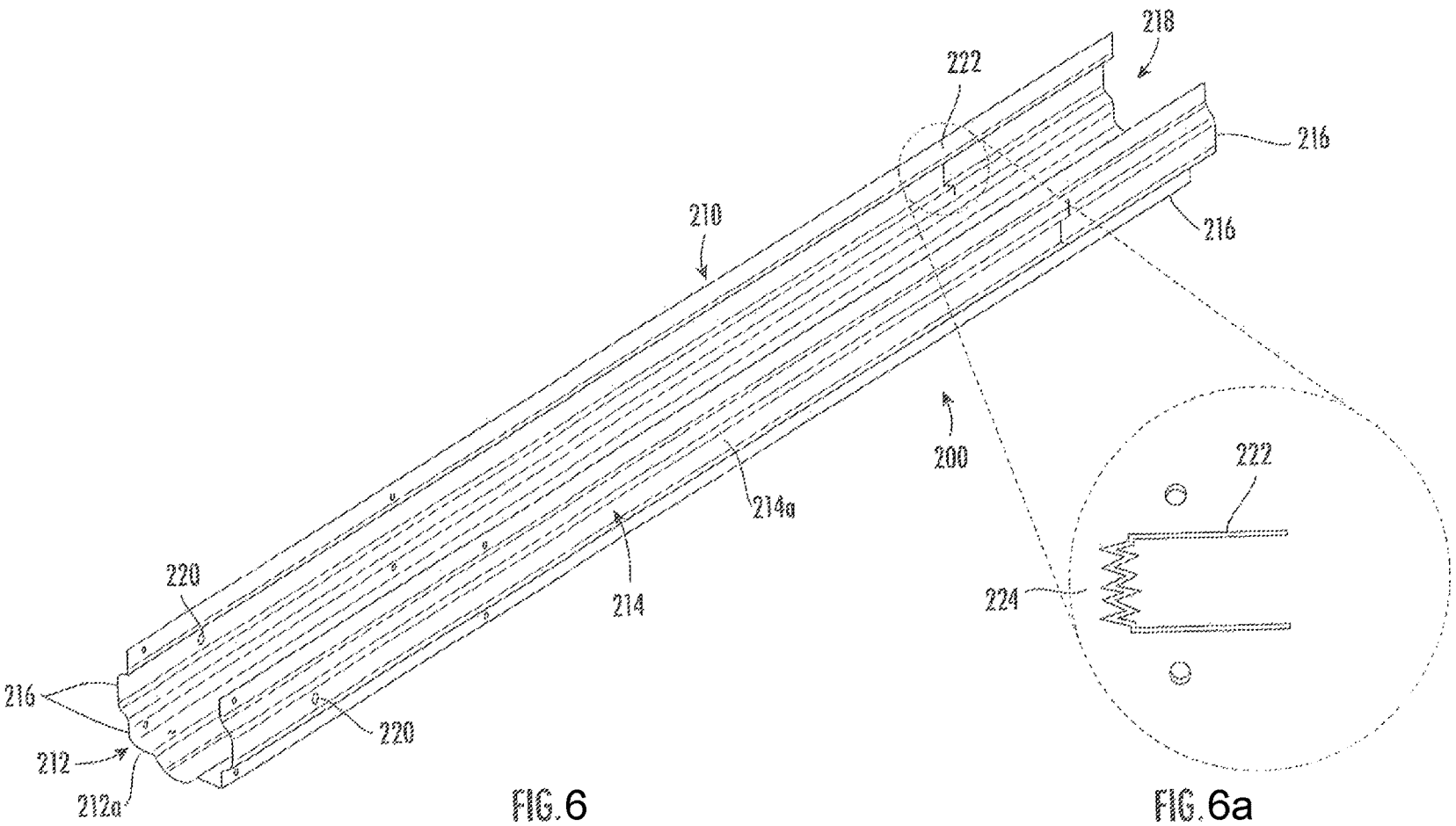
FIG. 6 illustrates a perspective view of an embodiment of a reinforcement sleeve according to the present disclosure.
FIG. 6*a* illustrates a close-up of an uplift tab found on the reinforcement sleeve shown in FIG. 6.
Figure 7:
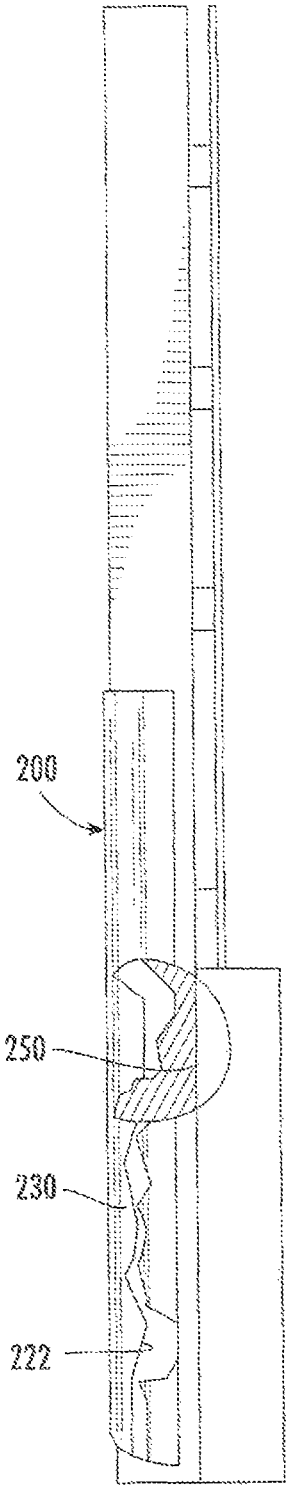
FIG. 7 illustrates the reinforcement sleeve according to the present disclosure positioned around a target column; and, FIG. 8 illustrates an interior view of a post frame structure incorporating an embodiment of a reinforcement sleeve according to the present disclosure.
Figure 8:
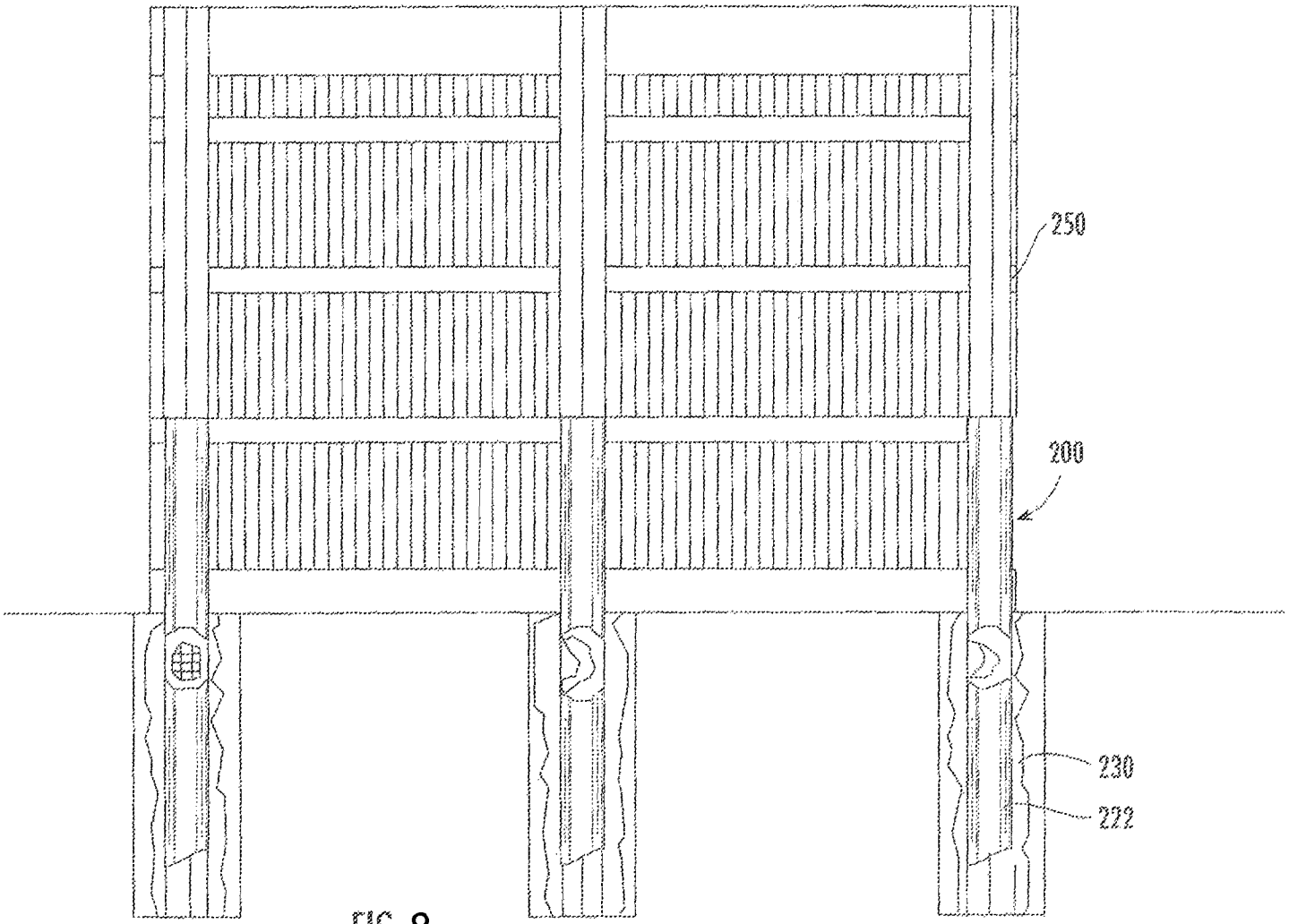

Now referring to the figures, wherein like numerals refer to like parts, FIGS. 1-4*a*-4*c* illustrate a reinforcement device 100, specifically, a height adjustable column assembly having a height adjustment mechanism therein. FIGS. 5-7 illustrate a reinforcement device, specifically a reinforcement sleeve useful for stabilizing and strengthening existing columns and/or posts of existing building structures, such as pole barns constructed from wooden posts. FIG. 8 illustrates an embodiment of a reinforcement device used for lifting an existing structure and increasing the interior space of the structure.

Figure 1:
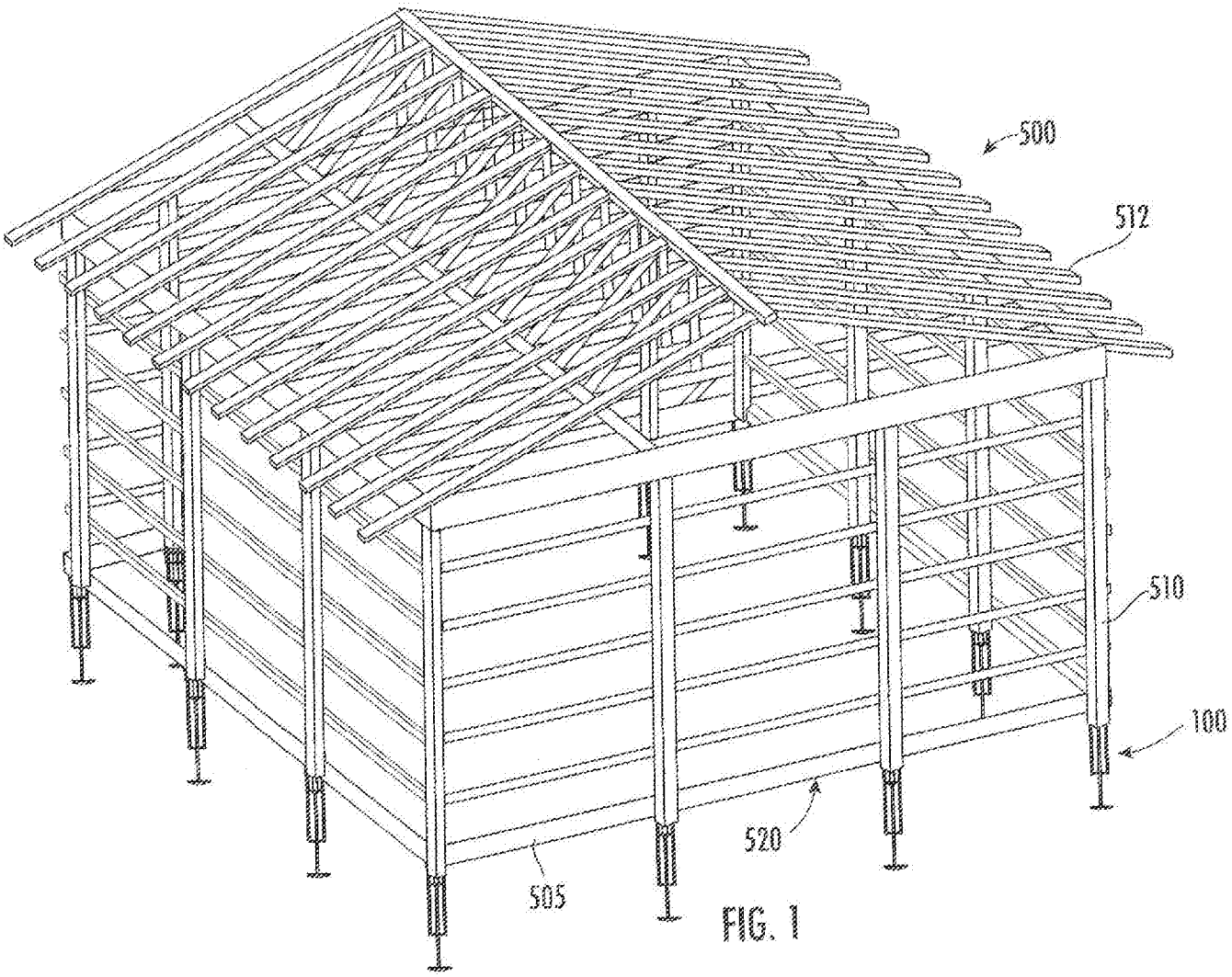
FIG. 1 illustrates a perspective view of a post frame structure incorporating an embodiment of a reinforcement device, particularly a height adjustable column assembly according to the present disclosure.
Figure 2:
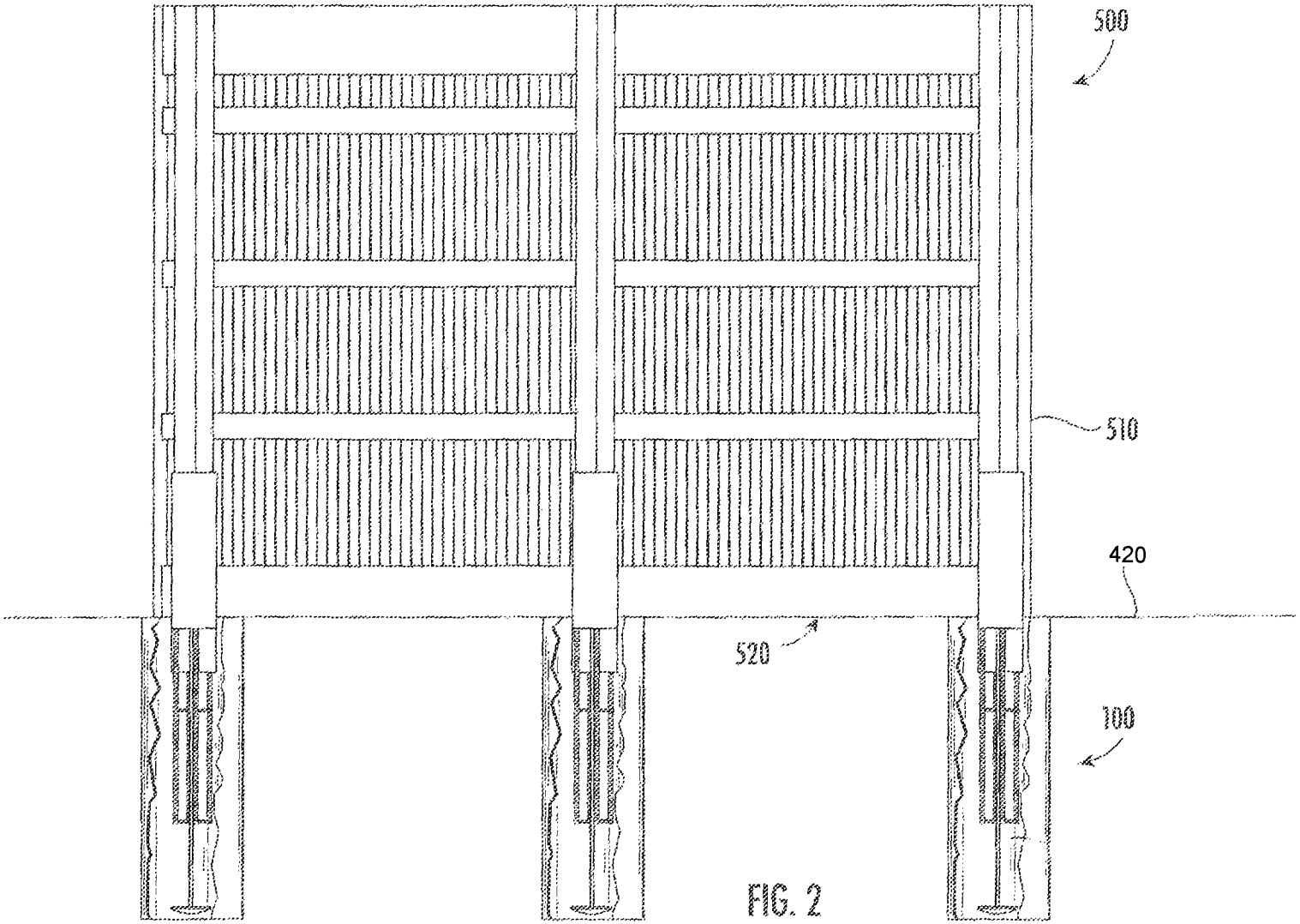
FIG. 2 illustrates a perspective view of the height adjustable column assembly in use with a post frame structure according to the present disclosure.

Creating a foundation for a structure, particularly a post-frame or pole barn structure 500, that is resistant to changing weather conditions, rot or decay, and insect-infestation, is vital for the long-term survival of the structure. Additionally, having options away from traditional wood and precast concrete as foundations supports is desirable to meet many of these requirements. As shown in FIGS. 1-3 and 4*a*-4*c*, an embodiment of a reinforcement device in the form of a height adjustable column assembly 100, is provided for use in the construction of a structure 500. The height adjustable column assembly 100 includes a column body 102 having a top 104 and a bottom 106, a bracket 120, 128 at the top of the column and a height adjustment mechanism 130. As shown in FIG. 2, for use as a foundation column, the column body 102 of the height adjustable column assembly 100 is placed within a hole 400 excavated for the perimeter of the foundation 520, while the bracket 120, 128 remains above the ground 420 for receiving and securing boards 300 (also referred to as planks or splashboards) used to create the foundation ultimately supporting the entire structure 500.

As shown in FIGS. 3 and 4*a*-4*c*, the column body 102 of the present height adjustable column assembly 100 is generally a cage formed from a plurality of reinforcing vertical bars 112, also referred to as "rebar," positioned to form an outer perimeter of the cage. For example, in one embodiment shown in FIG. 4*a*, four, evenly-spaced vertical bars 112 form a rectangular cage of the column 102. It should be understood that although four bars are shown, any number of vertical bars may be used to create the cage structure of the column. At least one reinforcement anchor 114 spans an interior space 116 inside the perimeter of the cage. Depending on the configuration of the column body 102, any number of reinforcement anchors may be incorporation. The reinforcement anchor 114 has generally a four leg star-shape, where each leg 114*a* of the anchor is rigidly connected, such as by welding, to each of one of the vertical bars 112. The reinforcement anchor 114 provides additional strength to the column body 102 and maintains the integrity of the column body as it is surrounded by dirt, gravel or concrete after the column assembly 100 is placed in the ground and leveled appropriately.

The top 104 of the column body 102 further supports a bracket 120, 128. The bracket 120, 128 is designed to receive and secure the boards 300, such as the splashboards or planks used to create the foundation, as well as, the upright column walls 510 for the building (FIGS. 3 and 4). As shown in detail in FIGS. 4*a* and 4*b*, the bracket 120 includes at least one upright arm 122 connected to a base 124. Each upright arm 122 further includes a notch 122*a* on an outer edge of each upright arm, the notch adapted for receiving a levelling string (not shown) useful in determining the overall level position of the column assembly 100. In another embodiment, the bracket 128 includes two upright arms 122 opposing each other and connected together by the base 124, forming a U-shaped bracket 128. The designated use of the height adjustable column assembly 100, as either a side wall column 128 (FIG. 4*a*) for use in the construction of a long side of the proposed building, or as a corner column 120 (FIG. 4*b*) for use in the joining of a corner of the propose building, dictates which embodiment of the bracket 120, 128 is needed. The bracket 120, 128 further includes a lip 129 which is used to further guide and support the vertical wall column 510 placed within the bracket 120, 128.

Figure 4A:
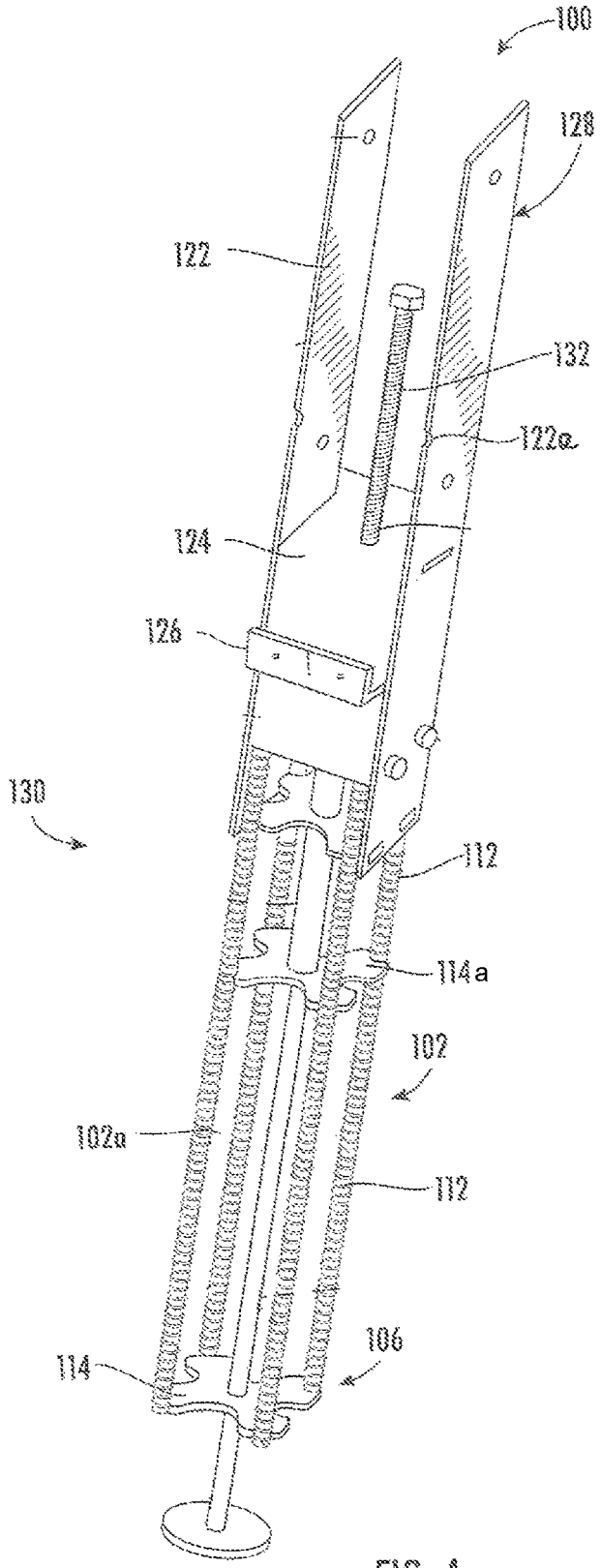
FIG. 4*a* illustrates a front view of an embodiment of a height adjustable column assembly according to the present disclosure.
Figure 4B:
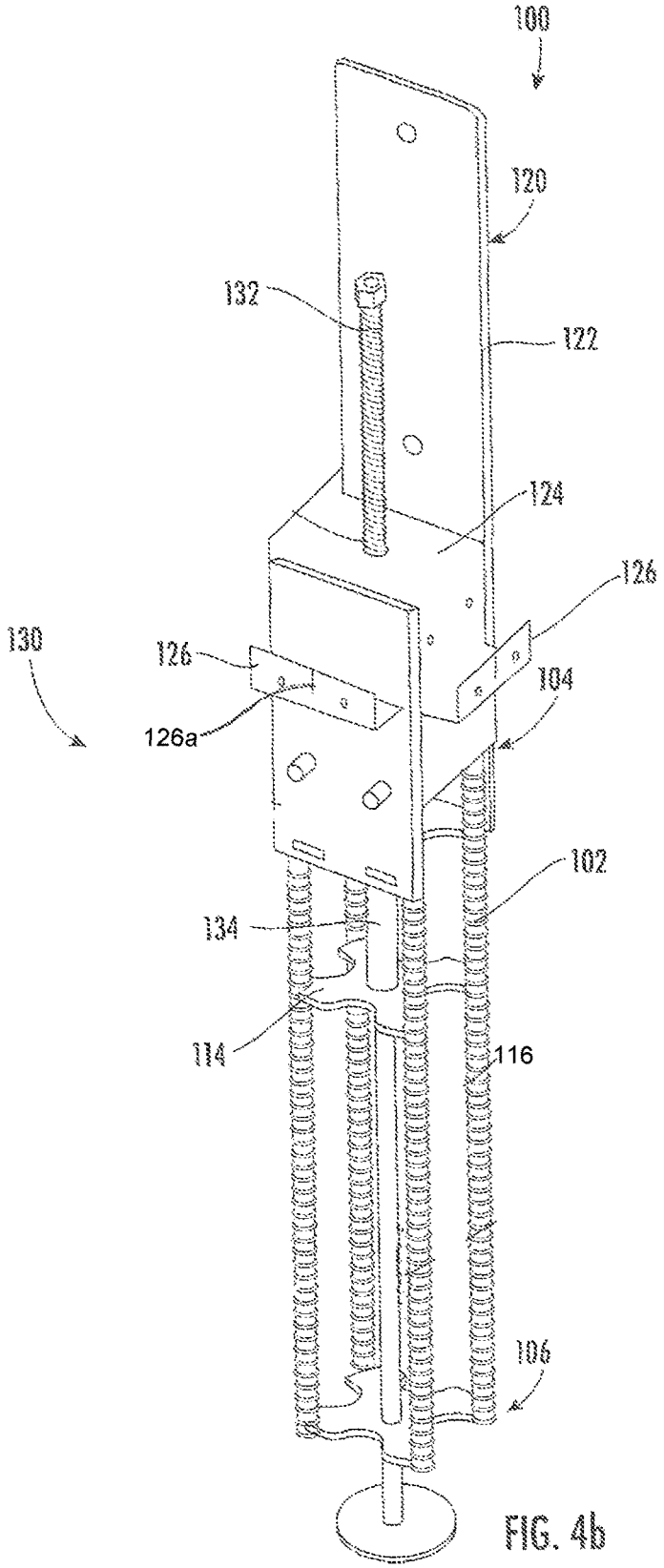
FIG. 4*b* illustrates a front view of an embodiment of a height adjustable column assembly for use as a corner support according to the present disclosure.
Figure 4C:
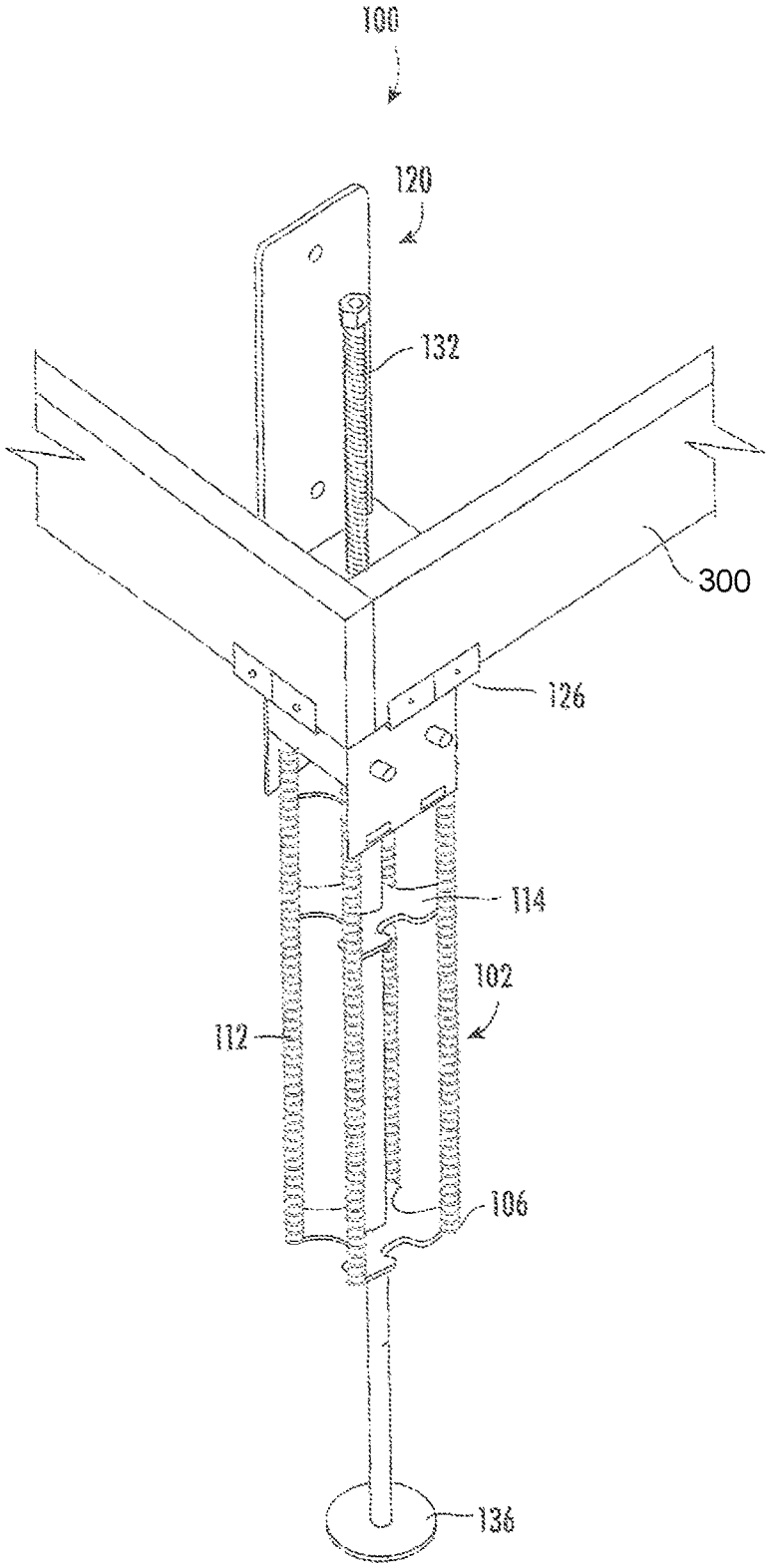
FIG. 4*c* illustrates a front view of an embodiment of a height adjustable column assembly for use as a corner support according to the present disclosure.

As shown in FIGS. 4*a* and 4*b*, the bracket 120 includes at least one integrated side support bracket 126. The side support bracket 126 is designed to receive a board 300 or plank, such as a splashboard or grade board used to create the foundation 520 of the building (FIGS. 3, 4 and 4*c*). Side support bracket 126 includes a vertical centerline in the form of a slot 126*a* used for accurate measurement of column spacing (typically about 8 feet apart) allowing precise placement of building columns (FIGS. 4*a*, 4*b*) when setting out the perimeter of the building. Depending on the placement of the height adjustable column assembly 100 in the construction of the foundation, the integrated side supports 126 are positioned on one side of the base 124 of the bracket 128 (FIG. 4*a*), or on perpendicular connected sides of the bracket 120, such as for corner placement (FIGS. 4*b* and 4*c*).

During construction of a new building, after multiple adjustable column assemblies 100 are placed in each of the respective excavated holes around the proposed perimeter of a building, the side supports 126 of each assembly engage a board 300, spanning across each of the assemblies (FIG. 4) to begin building the foundation 520. The column assemblies 100 are leveled through placement of a leveling string along each notch 122*a* on the outer edge of each upright arm 122. A laser level (not shown) is used in conjunction with the leveling string after it is placed in the notch 122*a* to assist in accurately leveling each of the column assemblies 100 after placement. After leveling the assemblies 100, grade boards or splashboards 300 are placed within each of the side support brackets 126. Because each grade board 300 interlocks within the side supports 126 of the column assembly 100, the entire foundation system is stabilized and no post movement occurs when installing structural columns 510 for ultimately supporting trusses 512 of the structure 500. The combination of the side supports 126 with the splashboards 300 keeps each of column assemblies 100 in position in the excavated hole 400 before the hole is filled with dirt, gravel or concrete and secured.

The present height adjustable column assembly 100 further includes a height adjustment mechanism 130. The height adjustment mechanism 130 includes a first threaded rod 132 disposed vertically above and through the bracket 120, 128, and into a second threaded rod 134, which is disposed vertically from the top 104 of the column body. The first threaded rod 132 extends downward through the column body ending at a base or foot plate 136, which is set at the bottom of an excavated hole. The foot plate 136 includes an angled bottom 137, which is adapted to engage the floor of the excavated hole, providing resistance when the height adjustment mechanism 130 is rotated to adjust the height of the assembly 100.

The height adjustment mechanism 130 provides an advantage over standard foundation columns because it provides the option to adjust the present adjustable column assembly 100 on-site, with precision, while the assembly is in an upright position and placed within an excavated hole. Rough height adjustments can be made prior to installation of the adjustable column assembly 100 into the excavated hole; however final adjustments can be made through the height adjustment mechanism 130. Specifically, the first threaded rod 132 passes through the bracket 120 for telescoping engagement with the second threaded rod 134. Using an appropriate tool, such as a screw gun, the first threaded rod 132 is rotated to precisely adjust the vertical height of the bracket 120, 128 after placement of the column assembly 100 into the excavated hole 400. The first threaded rod 132 can then either be removed or cut, so that a wall board 510 can be secured upright in the bracket 120 using known fasteners (FIG. 3). Thus, the adjustment mechanism 130 is useful to accommodate post holes of inconsistent depths and levels, because it permits custom, on-site levelling of the foundation boards 300.

The present height adjustable column assembly 100 is designed to replace the standard wood, concrete, or combination of both, traditionally used as foundation columns in post-frame or pole barn construction. Constructed from any suitable corrosion-resistant material, such as galvanized steel, the present height adjustable column assembly 100 is light-weight (weighing less than 60 pounds) and easily maneuverable for placement within an excavated hole 400. However, and unlike traditional wooden posts, which can rot and potentially fail, the present column assembly 100 is not susceptible to the elements or insect infestation, nor will the present column assembly expand and contract due to freezing and thawing. Additionally, and unlike traditional precast concrete columns, which are heavy and hard to maneuver once set in place, the light-weight construction of the present column assembly 100 allows for easy placement and adjustability, particularly in view of the height adjustment mechanism 130. Concrete columns as well can be susceptible to cracking and water damage, which can again jeopardize the overall stability of a structure.

Installation of the present height adjustable column assembly 100 in the construction of a post-frame building 500 is significantly easier than traditional foundation systems. Initially, a series of holes 400 are dug using known methods (for example, manually or using an auger) to create the intended perimeter of the building 500. A separate height adjustable column assembly 100 is set into each hole 400 (FIG. 2). Each height adjustable column assembly 100 comes preassembled, and the pre-drilled holes make for simple attachment using known fasteners to the integrated grade boards 300 or splash boards, which are set into the side support brackets 126 of the column assembly. The present column assembly 100 is much lighter than traditional wooden posts, making lifting safer, easier and reducing the need for heavy machinery to assist in transportation and installation. Each column 100 can be adjusted without difficulty and with precision while upright, which eliminates the need to correct wood post lengths on site. Additionally, another advantage of using the present adjustable column assembly 100 is that post hole depths do not need to be exact, and the standard height industry variation of +/−3 inches is done away with. After the appropriate height adjustment is complete using the height adjustment mechanism 130, the excavated holes 400 can be filled with dirt, gravel or concrete to set the adjustable foundation column assemblies 100 in place to create the foundation.

The features and advantages offered by the present height adjustable column assembly 100 mean that installation of the foundation column is quick, yet precise. Each column assembly 100 can be accurately put in place quickly, with a typical installation of an entire foundation for a post-frame structure being completed in a single day. The speed and precision of installation makes the column assembly 100 ideal for stub ahead projects; crews can dig, set the columns and install the splashboard prior to concrete backfill. This is also beneficial to the new building owner because it allows subsurface work (plumbing, electrical, in-floor heat, etc.) to be complete and concrete flooring poured prior to the crew returning to build the building.

In short, the time savings in installation combined with the durability of foundation built using the present adjustable column assembly 100 translate directly into extensive cost and labor savings when compared to other foundation methods. The lightweight nature of the present column assembly 100 and the reduced need for tools make job sites safer, resulting in more efficient crews. Since column heights can be easily adjusted on site, supporting structural wood columns can arrive pre-cut and ready for attachment to the foundation system.

Advantages of the present height adjustable column assembly 100 include that it is invulnerable to the rot, decay and insect damage that traditional wooden posts are susceptible to, nor will the present foundation column expand and contract due to freezing and thawing. The superior strength of the galvanized steel foundation column of the present assembly 100 means that the structural foundation will never twist or warp, allowing foundations that utilize the present device and system to be more durable and well-protected against destructive natural forces than the average post frame building foundation.

As an alternative to new construction of a building, oftentimes there is a need or desire to repair and reinforce existing post-frame structures, specifically the wood foundation columns found in many post-frame structures, barns and other buildings. Repair or reinforcement is preferred in terms of time and costs over complete replacement of wooden columns in many of these structures. Additionally, razing a structure may not be an option if the structure has historical or family value.

Figure 6B:
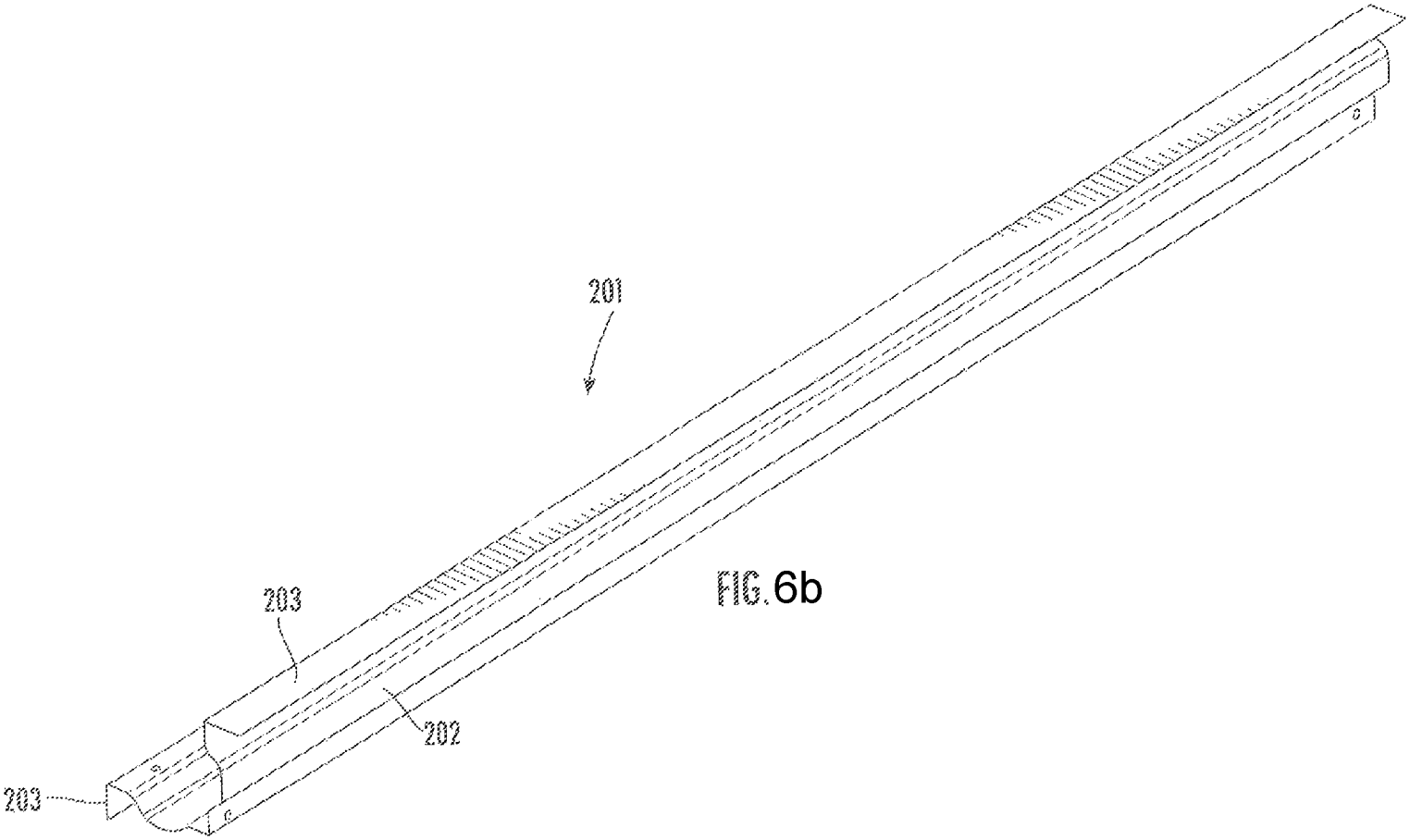
FIG. 6*b* illustrates a perspective view of an embodiment of a reinforcement sleeve according to the present disclosure.

As shown in FIGS. 5-8, an embodiment of a reinforcement device in the form of a multi-sided sleeve 200, is provided, which is useful for engagement with existing wooden columns 250 in post frame buildings. As illustrated in FIGS. 5 and 6, the reinforcement sleeve 200 includes an elongated body 210 comprising a longitudinal center section 212 integrally connected to a pair of opposing longitudinal legs 214 or side panels having a length equal to the center section. Each leg 214 includes multiple angles or bends 216. It should be understood that the angles or bends can vary in number and degree, and are adjustable for accommodating columns or posts of varying sizes. The resulting structure is a three-side configuration with an opening 218 having an inner surface 218*a* that enables the sleeve to be adjusted and wrapped around three sides (the face and two sides) of an existing column 250 or post having a variety of shapes and sizes. Optionally, as shown in FIG. 6*b*, the sleeve 201 may include a slightly modified configuration, which is useful for corner or jamb columns. In this corner sleeve 201, the side panels 202 include an outer lip 203 configured for meeting the walls of a structure at the corner of the structure.

The reinforcement sleeve 200 has an overall corrugated shape, including a plurality of curved bends 216, folds or parallel and alternating ridges and grooves formed within the side panels 214 and the center section 212. For example, and as shown in FIG. 5, in one embodiment, the center section 212 is includes a raised center 212*a*. Additionally, each side panel 214 includes a raised portion 214*a* in each panel. The raised center 212*a* and side panel raised portions 212*a*, 214*a* provide the sleeve 200 with the adjustability to fit any shape of existing column 250, and lends strength to the sleeve. It should be understood that the raised portions 212*a* and 214*a* of the center section and side panels, respectively, can have any shape of bend, curve, ridges or grooves, and thus the disclosure should not be limited to the embodiment shown.

As shown in FIGS. 6 and 6*a*, the reinforcement sleeve 200 further includes at least one uplift tab 222 positioned on one or both of the side panels 214, The uplift tab 222 includes a plurality of teeth 224 (FIG. 6*a*). When the reinforcement sleeve 200 is placed over the existing wooden column 250, and driven down around the column with a suitable manual tool (i.e., hammer or maul), jack hammer, hydraulic device or another other suitable means for driving the sleeve into the ground, the teeth 224 of the uplift tab 222 engage into the sides of the column 250 (FIGS. 7 and 8). In this manner, the reinforcement sleeve 200 is secured around the wooden column 250, and it cannot be removed.

The reinforcement sleeve 200 can be constructed from any suitable material, preferably steel, including galvanized steel for strength, longevity and corrosion-resistance. Additionally, the reinforcement sleeve 200 can have any length required for the particular project. For example, a sleeve 200 used for strengthening an existing column or post may be shorter in length than a sleeve that will be used for extending the height of a structure. Once installed into the ground 230 around an existing support column 250, the reinforcement sleeve 200 can be secured to the existing support column, using any manner of fastener including nails, screws, bolts, etc., through fastener holes 220 on the sleeve. The reinforcement sleeve 200 acts to stiffen and reinforce the lower portion of the wooden column 250 against lateral, uplift, and downward pressures. Additionally, straps (not shown) may be used to further fasten the reinforcement sleeve 200 around the column 250 or post.

Installation of the reinforcement sleeve 200 may be completed with a specialty hydraulic driving device, similar to an automatic jack hammer, which mechanically drives the sleeve into the ground around the target column 250. An advantage of using the hydraulic driver is that it reduces the amount of digging required to place the reinforcement device 200 into position. Although a slight amount of digging may be required around the base of the post or column to initially place the reinforcement device 200, the driver secures the reinforcement device below grade using less time and manpower than traditionally required to place a second securing post. It should be understood that in place of the described driver, the reinforcement sleeve can also be installed using any suitable manual tool (i.e., hammer or maul), jack hammer, or another other suitable means for driving the sleeve into the ground.

Wood columns used to construct post frame buildings tend to fail over time due to dry rot and decay caused by microbial activity at the soil surface and just below the surface. This creates a risk of column failure or building damage, which is a real problem for the building owner, and can be very expensive to repair. The present disclosure also includes a system and method for reinforcing a column, post or other supporting structure for a building using the reinforcement device 200.

The system and method for reinforcing and/or stabilizing a column 250 or post includes the steps of initially digging a shallow hole 230 or trench around the base of the target column 250. The reinforcement sleeve 200 is then positioned within the hole 230 and over the existing column 250 from inside the building. Because of the corrugated shape of the reinforcement sleeve 200, the center section 212 and legs or side panels 214 of the sleeve cradle and contact the column at multiple contact points as shown in FIG. 5. For example, as noted in the figure, the raised portions 212*a*, 214*a* of each of the center section and legs do not directly contact the column 250. The corrugated shape of the reinforcement sleeve 200 provides strength and spacing needed to drive the sleeve into position around the column. If the sleeve 200 fit tight against the column 250, it would be harder to drive the sleeve down into position.

Although a reinforcement sleeve 200 is described as an option for reinforcing an existing wooden column, there is an option to use the height adjustable column assembly 100 described above in the repair of a structural column. Specifically, the existing column can be dug out of the ground and removed. The adjustable column assembly 100 would then be positioned in the ground, completely replacing the wooden column. Because the adjustable column assembly is not susceptible to the elements, or insect infestation, it would provide a long-term solution to maintaining the foundation of the existing building.

For decades, post frame buildings were built all across America that were designed to store equipment and machinery that was much smaller than what is in use on today's modern farms. As a result, many of these otherwise useful buildings are being removed to make room for new buildings with higher interior clearances. However, there is often a reason to save and restore existing buildings, including costs, historical value and sentimental value.

The present disclosure includes a system and method for raising the height of an existing structure by up to 36", thereby increasing the useful interior space. The system and method for raising the height of a structure includes using the present reinforcement sleeve 200. The reinforcement sleeve 200 can have any suitable length, for example up to 12 feet long, which makes the reinforcement sleeve useful for raising an older, shorter building to a newer height. Once the reinforcement sleeve 200 is installed around an existing column 250 as previously described, the existing wood columns can be extended up to 36", thereby increasing the interior clearance and allowing the height needed for today's modern farm equipment, construction equipment, or just to provide additional interior storage space within an existing structure.

The method of raising an existing structure begins with cutting an existing column will both sides and on the face of the column. The reinforcement sleeve 200 will be driven into the ground (using some form of a driver as described above), leaving a suitable portion of the sleeve above grade. The remaining portion of the column 250 would then be cut separating the column into two pieces. The building or structure would be jacked up or lifted incrementally using known methods and equipment (i.e., jacks), until it reached the desired height. The gap from the lift would be filled with an appropriate filler. A vertical fastener, such as a steel strap would be used to fasten and tie all the pieces together, including the sleeve 200, which would also be attached to the column 250. After raising the structure to the desired height, any void left under the existing sidewall would be filled in with appropriate material, for example, a new steel wainscot.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

We claim:

1. A device for reinforcing an existing structural element of a building, the device comprising:

a sleeve having an elongated body comprising a longitudinal center section having a plurality of vertically disposed ridges and grooves along a length of the center section, the longitudinal center section integrally connected along opposing edges to a pair of opposing longitudinal panels, each panel having a plurality of ridges and grooves along a length of the panel, wherein the opposing panels and the center section form an adjustable opening for engaging the structural element.

2. The device of claim 1, wherein each panel has a length equal to a length of the center section.

3. The device of claim 1, wherein the opening is substantially a C-shape.

4. The device of claim 3, wherein the opening includes a corrugated inside surface adapted for engagement with the structural element of the building.

5. The device of claim 4, wherein the corrugated inside surface is configured to engage an outer surface of the structural element forming a reinforcing structure.

6. The device of claim 1, wherein the structural element is a column or post of an existing building.

* * * * *